United States Patent [19]

Locarno

[11] Patent Number: 5,027,445

[45] Date of Patent: Jul. 2, 1991

[54] RAISED SUPERIMPOSED TOILET SEAT AND SECURING CLAMP

[76] Inventor: Michael M. Locarno, R.D. 3, Box 462, Boonton, N.J. 07005

[21] Appl. No.: 559,151

[22] Filed: Jul. 26, 1990

[51] Int. Cl.[5] ..... A47K 13/06

[52] U.S. Cl. ..... 4/235; 4/239; 4/254

[58] Field of Search ..... 4/239, 254, 235; D23/311

[56] References Cited

U.S. PATENT DOCUMENTS

| | | | |
|---|---|---|---|
| D. 237,887 | 12/1975 | Landsberger | D23/311 |
| D. 242,457 | 11/1976 | Landsberger | D23/311 |
| D. 287,399 | 12/1986 | Brocils | D23/311 |
| D. 287,533 | 12/1986 | Brocils | D23/311 |
| D. 287,534 | 12/1986 | Brocils | D23/311 |
| 4,462,122 | 7/1984 | Broeils | 4/239 |
| 4,477,932 | 10/1984 | Lenosky | 4/239 |

*Primary Examiner*—Charles E. Phillips
*Attorney, Agent, or Firm*—Anthony F. Cuoco

[57] ABSTRACT

A raised toilet seat is superimposed upon the bowl of a conventional toilet. A clamp has a section which includes pins that engage holes in a recess on the underside of the seat at the rear thereof to secure the clamp to the seat. The clamp has another section which extends from the rear of and beyond the seat and which fits into a space provided when the lid and the seat of the conventional toilet are lifted. In a modified form the clamp has end sections which extend beyond the sides of the seat at the rear thereof, and which end sections support user support members or the like, for enhancing the use of the seat for those who have need for same.

7 Claims, 4 Drawing Sheets

RAISED SUPERIMPOSED TOILET SEAT AND SECURING CLAMP

BACKGROUND OF THE INVENTION

Raised toilet seats which are superimposed upon conventional toilets are an indispensable aid for invalids and others who experience difficulty in sitting on and raising from a conventional toilet seat. The raised superimposed toilet seat is disposed directly on the bowl of the conventional toilet and offers complete comfort to the user as is described. Toilet seats of the type contemplated are described, for example, in U.S. Pat. No. Des. 237,887 and U.S. Pat. No. Des. 242,457 issued to Kurt Landsberger on Dec. 2, 1975 and Nov. 23, 1976, respectively.

These seats are often used with conventional toilets as aforenoted without any clamping device to securely mount the seats to the conventional toilets. While this arrangement is sufficient in many situations, it is often required to accommodate the capabilities of the user, to clamp the raised superimposed seat to the conventional toilet to secure the seat thereto and to otherwise provide a degree of stability to the seat when it is being used. Clamps have been used for this purpose which feature a section secured to the toilet seat and a section which fits into a space provided when the lid and the seat of the conventional toilet are lifted. Clamps of the type described are disclosed and claimed in, for example, the following U.S. Patents: U.S. Pat. No. 4,462,122 issued on July 31, 1984 to John Broeils; U.S. Pat. No. 4,477,932 issued on Oct. 23, 1984 to Theodore Lenosky; and U.S. Pat. Nos. Des. 287,533, 287,399 and 287,534 issued on Dec. 30, 1986, Dec. 23, 1986 and Dec. 30, 1986, respectively, to John Broeils.

The present invention discloses an improved and more versatile clamp than the clamps described in the aforenoted prior art.

SUMMARY OF THE INVENTION

This invention contemplates a raised toilet seat which is superimposed upon the bowl of a conventional toilet. With the lid and the seat of the conventional toilet in a lifted position, a space is provided between the lifted seat and lid and the section of the toilet connecting the bowl and water tank of the toilet. A clamp has a section which fits into a recess on the underside of the raised seat and carries pins which engage holes on said seat underside for securing the clamp to the raised seat. The clamp has another section extending from the rear of the raised seat which fits into the space so as to be retained therein. The cooperative action of the clamp with the raised superimposed seat and the conventional toilet is effective for securing said seat to said conventional toilet. In a form of the invention, the clamp has sections which extend from the sides of the seat, and which sections are adapted for supporting safety or support members for enhancing the versatility of the raised seat.

DETAILED DESCRIPTION OF THE INVENTION

Figure 3:
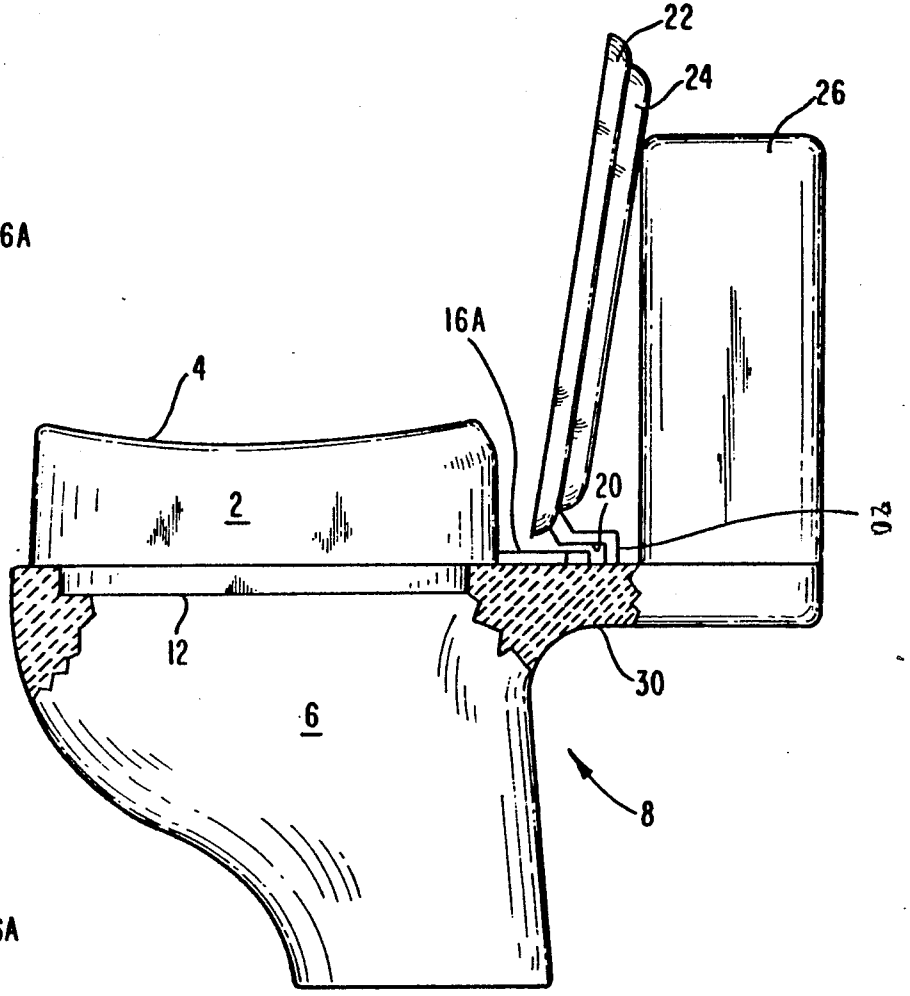
FIG. 3 is a diagrammatic, partially sectioned side view showing the raised toilet seat shown in FIGS. 1 and 2 superimposed on a conventional toilet bowl, and showing the clamp section extending from the rear of the raised seat according to the invention, whereby the raised seat is secured to the conventional toilet.
Figure 1:
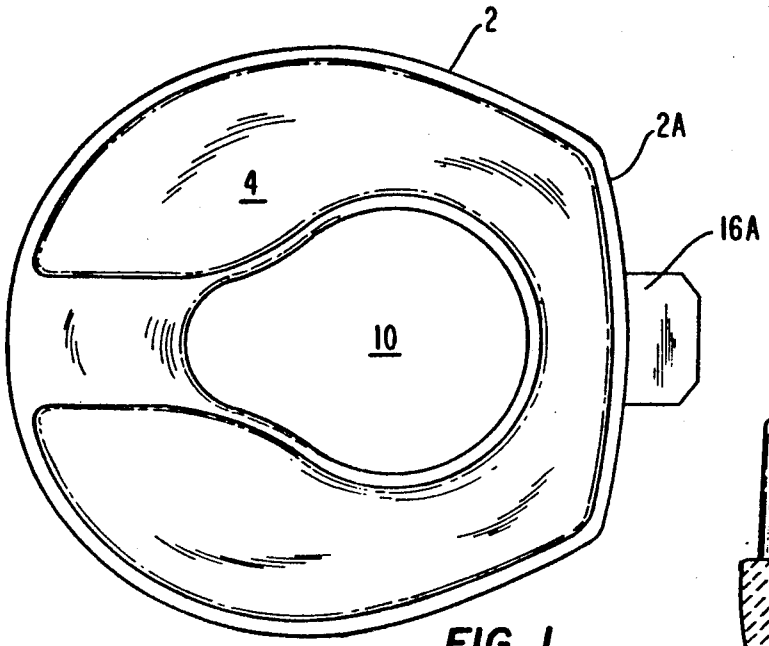
FIG. 1 is a diagrammatic top view of a raised toilet seat showing a clamp section extending from the rear thereof in accordance with the invention.
Figure 2:
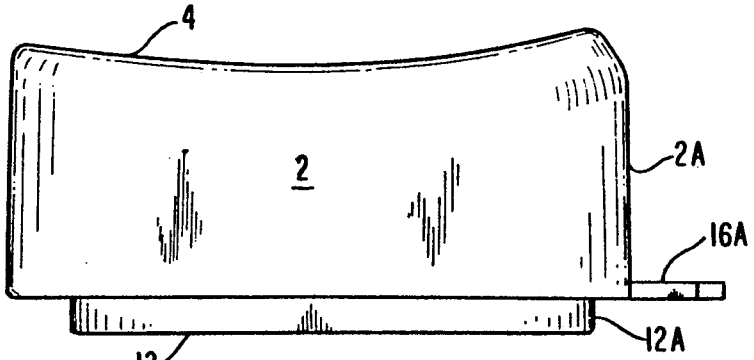
FIG. 2 is a diagrammatic side view of the raised toilet seat, the top view of which is shown in FIG. 1, and showing the clamp section extending from the rear thereof in accordance with the invention.

With reference to FIGS. 1, 2 and 3, a raised toilet seat is designated generally by the numeral 2. Raised or elevated toilet seat 2 may be of various configurations such as described in the aforenoted U.S. Pat. Nos. Des. 237,887 and 242,457 and is shown in FIGS. 1, 2 and 3 in its simplest form for purposes of describing the invention. It will therefore suffice to say that the top 4 of raised toilet seat 2 is suitably contoured and rests on the rim of a bowl 6 of a conventional toilet 8. Seat 2 has a through opening 10 disposed substantially central to the seat as best shown in FIG. 1.

Figure 4:
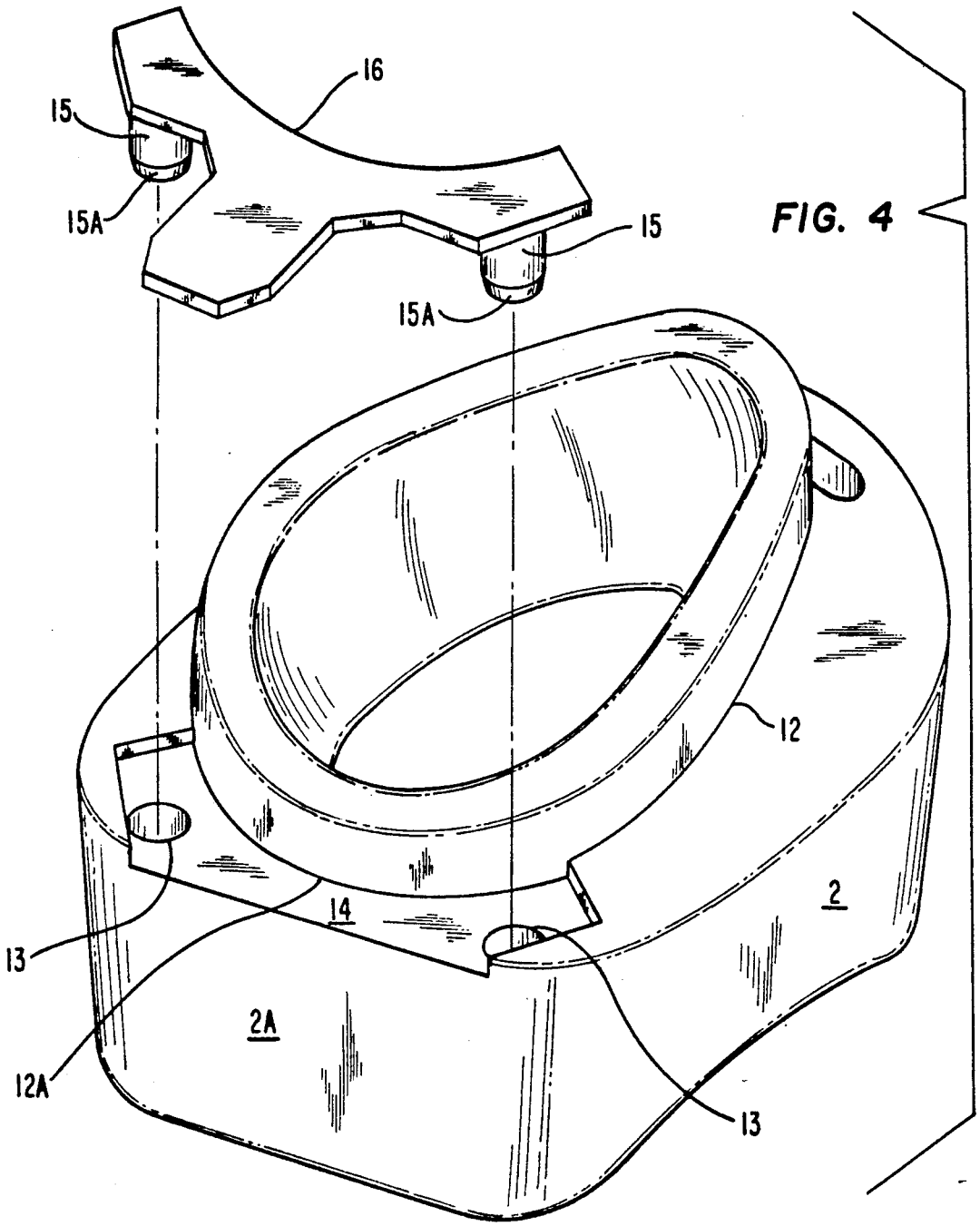
FIG. 4 is an exploded view showing a clamp according to the present invention in cooperative arrangement with the underside of the raised superimposed toilet seat.

Seat 2 has a lower portion 12 which is smaller than top 4 of the seat so as to fit within toilet bowl 6 of conventional toilet 8 (FIGS. 2 and 3) and has a back portion 12A. In modifying seat 2 for purposes of the present invention, the underside of the seat at rear end 2A thereof carries a recess designated generally by the numeral 14 in FIG. 4. Recess 14 has holes 13 in spaced relation therein which are engaged by correspondingly spaced pins 15 extending from a clamp 16. Back 12A of lower seat portion 12 is arcuate in shape and the front of recess 14 which is adjacent lower seat portion back 12A is likewise arcuate in shape so that the front of the recess follows the back of the lower seat portion as best shown in FIG. 4. Clamp 16, the front of which is arcuate in shape to match the corresponding arcuate shapes of the recess front and the lower seat portion back, is particularly illustrated in FIG. 4.

Pins 15 engage holes 13 in snug fit relation so that clamp 16 is secured to the seat when a downward force is exerted as by a user sitting on said seat, and the clamp is removed from the seat when an opposite force is exerted. The engagement of pins 15 and holes 13 is facilitated by tapered portions 15A of clamps 15 as will now be discerned.

Thus, with clamp 16 secured to seat 2 as aforenoted, a section 16A thereof extends rearwardly from and beyond rear end 2A of seat 2, with lower portion 12 of the seat resting within bowl 6, the same being particularly illustrated in FIGS. 1, 2 and 3. Clamp section 16A is disposed within a space 20. Space 20 is provided when a seat 22 and a lid 24 of conventional toilet 8 are in a lifted position so as to rest against a water tank 26. Space 20 is provided between a conventional coupling arrangement 28 and a bowl and tank connecting section 30. Coupling arrangement 28 is symbolically shown in FIG. 3 and enables seat 24 and lid 22 to be raised and lowered relative to toilet bowl 6.

Clamp section 16A, in association with space 20, is shown generally in FIG. 3. Only as much of conventional toilet 8 is shown and described as is necessary to understand the present invention.

Figure 5:
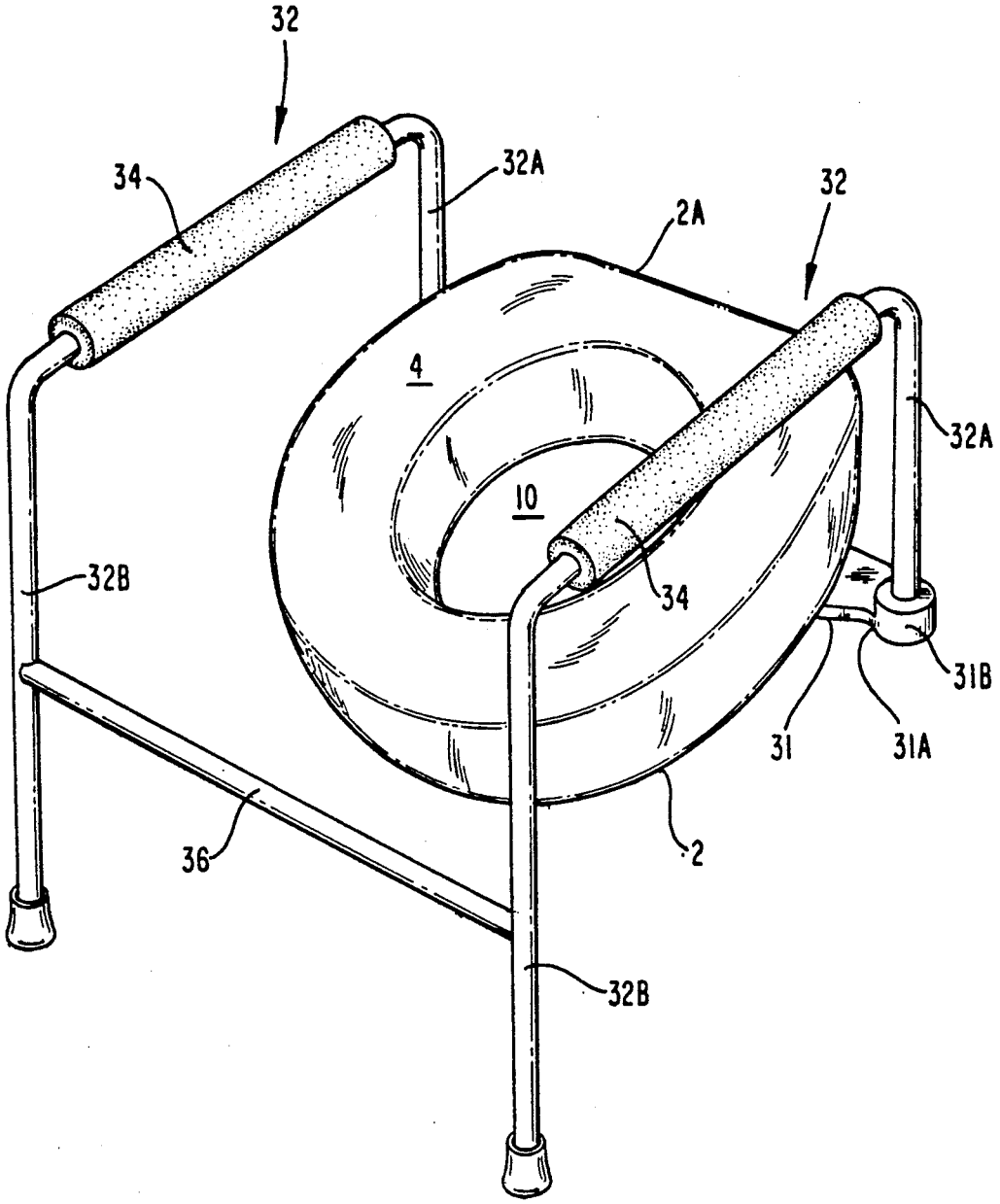
FIG. 5 is a perspective view showing a form of clamp illustrated in FIG. 4 adapted for supporting safety bars.

With reference to FIG. 5, clamp 16 is modified to provide a clamp 31 having end sections 31A which extend beyond the sides of seat 2. Each of the end sections 31A carries a boss or the like 31B, only one of which end sections and bosses is visible in the Figure, for supporting a rear leg 32A of a safety rail or the like 32. Safety rails 32 carry padded arm rests 34 and are coupled at their front legs 32B via a front support bar 36.

Figure 6:
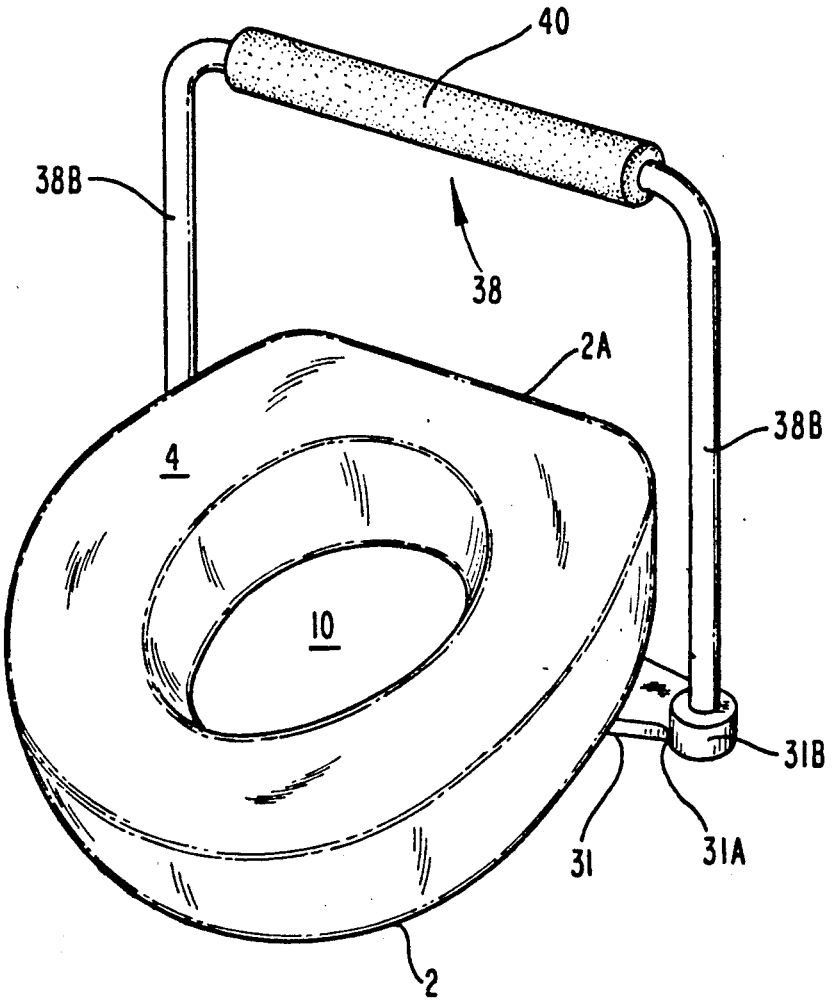
FIG. 6 is a perspective view showing the form of clamp illustrated in FIG. 5 supporting a back support member.

A similar arrangement is shown in FIG. 6, except bosses 31B, only one of which is visible in the Figure, support the opposite legs 38B of a back rest 38, having a padded rear support member 40.

While safety rails 32 and back rest 38 are shown and described, it will be understood that other support members for other purposes may be supported by bosses 31C, the same being contemplated by the invention.

In accordance with the aforegoing description of the invention, a raised superimposed toilet seat and securing clamp have been provided in combination, whereby the raised seat is superimposed on the bowl of a conventional toilet with the seat and the lid of the conventional toilet in a raised position against the water tank. The clamp is in cooperative relation with the raised superimposed seat and the toilet so as to firmly secure said seat in a superimposed position on the conventional toilet.

The arrangement described maximizes user comfort, stability and safety and thus enhances the use of raised superimposed toilet seats by elderly persons and others who suffer immobilizing infirmities to the extent that they are unable to use conventional toilet seats. The aforenoted clamping precludes movement of the raised superimposed toilet seat as might otherwise occur upon a user lowering or lifting the body relative to the raised seat.

For purposes of fabricating the invention, seat 2 may be of a suitable molded plastic such as polyethylene and clamp 16 may likewise be of a suitable molded plastic such as acetal butyl styrene (ABS), the latter material having strength characteristics consistent with the use of the invention.

With the aforegoing description of the invention in mind, reference is made to the claims appended hereto which define the scope of the invention.

What is claimed is:

1. For use with a toilet of the type having a bowl including a rim, a water tank, a section connecting the bowl to the tank, a seat and a lid, means coupling the seat and lid to the connecting section so that the seat and lid can be lifted relative to the bowl, with a space being provided between the coupling means and the connecting section when said seat and lid are lifted to rest against the tank, in combination, an elevated seat, superimposed on the toilet bowl rim said seat having a removable clamp for securing said elevated superimposed seat to the toilet, comprising:

the elevated seat including an upper portion which rests on the bowl rim and includes an upper contoured seating surface surrounding an opening which communicates with the bowl interior and an underside, a lower portion extending from the underside and which fits into the bowl and a recess on the underside of the upper portion at a rear portion thereof, said recess having a pair of holes in spaced relation;

the clamp including a first section disposed in the recess and having a pair of pins extending upwardly therefrom in corresponding spaced relation to and engaging said holes, and a second section extending rearwardly from and beyond the first section radially outwardly of the seat;

the second section being received in the space between the coupling means and the connecting section so as to be captured therein; and the first and second sections of the clamp thereby being in cooperative relation with the elevated superimposed seat and the toilet, respectively, to secure said seat to said toilet.

2. A combination as described by claim 1, wherein:

the pair of pins extending downwardly from the first clamp section have tapered end sections for facilitating the engagement of the pins and the holes in the recess; and the pins engaging the holes in snug fit relation, whereby said pins are seated in said holes and the clamp is secured to the underside of the raised seat when a downward force is exerted on the seat by a user sitting thereon.

3. A combination as described by claim 1, wherein:

the clamp has opposite end sections which extend beyond corresponding opposite sides of the raised seat; and said end sections are adapted for supporting user support members.

4. A combination as described by claim 1, wherein:

the back of the lower portion of the raised seat which fits into the bowl is arcuate in shape;

the front of the recess being adjacent the rear of the lower portion of the raised seat being likewise arcuate in shape so as to follow the rear of said lower seat portion; and the front of the first section of the clamp which is disposed in the recess is arcuate in shape so as to correspond to the arcuate shapes of the front of the recess and the back of said seat portion.

5. For use with a toilet of the type having a bowl including a rim, a water tank, a section connecting the bowl to the tank, a seat and a lid, means coupling the seat and lid to the connecting section so that the seat and lid can be lifted relative to the bowl, with a space being provided between the coupling means and the connecting section when said seat and lid are lifted to rest against the tank, in combination, an elevated seat, superimposed on the toilet bowl rim said seat having a removable clamp for securing said elevated superimposed seat to the toilet, comprising:

the elevated seat including an upper portion which rests on the bowl rim and includes an upper contoured seating surface surrounding an opening which communicates with the bowl interior and an underside, a lower portion extending from the underside and which fits into the bowl and a recess on the underside of the upper portion at a back portion thereof, said recess having a pair of holes in spaced relation;

the clamp having a first section disposed in the recess and having a pair of pins extending upwardly therefrom in corresponding spaced relation to and engaging said holes, and a second section extending rearwardly from and beyond the first section radially outwardly of the seat;

the second section being received in the space between the coupling means and the connecting section so as to be captured therein;

the clamp having opposite end sections which extend beyond corresponding opposite sides of the raised seat; and the first and second sections of the clamp being in cooperative relation with the raised superimposed seat and the toilet, respectively, to secure said seat to said toilet, and said end sections having user support members extending upwardly therefrom.

6. A combination as described by claim 5, wherein:

the pins engage the holes in snug fit relation, whereby said pins are seated in said holes and the clamp is secured to the underside of the raised seat when a downward force is exerted on the seat by a user sitting on said seat.

7. A combination as described by claim 6, wherein:

the back of the lower portion of the raised seat which fits into the bowl is arcuate in shape;

the front of the recess which being adjacent the back of the lower portion of the raised seat being likewise arcuate in shape so as to follow the back of said lower seat portion; and the front of the first section of the clamp which is disposed in the recess is arcuate in shape so as to correspond to the arcuate shapes of the front of the recess and the back of said seat portion.

* * * * *